US006079308A

United States Patent [19]

Beyrich et al.

[11] Patent Number: 6,079,308

[45] Date of Patent: Jun. 27, 2000

[54] APPARATUS FOR SHEET-METAL PLATE PROCESSING TO BE EMPLOYED AT INCLINED C-FRAME PRESSES

[75] Inventors: Karlheinz Beyrich, Aue; Uwe Hattwig, Lauter; Frieder Kraus; Achim Kreher, both of Aue; Wilfred Lang, Bernsbach, all of Germany

[73] Assignee: Gebruder Leonhardt Im-Und Export GmbH & Co. KG, Aue, Germany

[21] Appl. No.: 08/851,417

[22] Filed: May 5, 1997

[30] Foreign Application Priority Data

May 3, 1996 [DE] Germany ..... 196 17 704

[51] Int. Cl.[7] ..... B24D 1/00

[52] U.S. Cl. ..... 83/713; 83/715; 83/923; 72/14.8; 72/336; 72/339; 100/231

[58] Field of Search ..... 83/35, 36, 39, 83/76.1, 713, 715, 923, 202, 257; 72/14.8, 336, 339; 100/39, 94, 97, 231, 269.17

[56] References Cited

U.S. PATENT DOCUMENTS

| | | | |
|---|---|---|---|
| 5,522,295 | 6/1996 | Chun | 83/552 |
| 5,622,068 | 4/1997 | Sjoberg | 83/923 |

FOREIGN PATENT DOCUMENTS

| | | |
|---|---|---|
| 177684 | 11/1906 | Germany . |
| 508474 | 9/1930 | Germany . |
| 9408740 | 4/1994 | WIPO . |

*Primary Examiner*—M. Rachuba
*Attorney, Agent, or Firm*—Horst M. Kasper

[57] ABSTRACT

An apparatus is provided for a plate processing at inclined C-frame presses for an automatic cutting of tin-can covers and lids of tin cans and the like from sheet-metal plates with a piston plunger of a press moving up and down, where the sheet-metal plate is led step-by-step past under the piston plunger of the press. The apparatus includes a u-shape-formed frame 1. The longitudinal traverses 2 are in each case connected through a c-shaped bracing 3 to a C-shaped press frame 4.

13 Claims, 2 Drawing Sheets

APPARATUS FOR SHEET-METAL PLATE PROCESSING TO BE EMPLOYED AT INCLINED C-FRAME PRESSES

FIELD OF THE INVENTION

The present invention relates to an apparatus for the processing of sheet-metal plates for conventional and commercially available, inclined C-frame presses.

BRIEF DESCRIPTION OF THE BACKGROUND OF THE INVENTION INCLUDING PRIOR ART

A machine for the automatic punching-out of tin-can covers or lids from sheet-metal plates is known from the German Patent DE-PS 177,684. This machine includes a C-frame construction, wherein the press table including the mechanical sheet-metal plate processing device exhibit a position inclined by about 30 degrees, i.e. an inclined disposition of the press table relative to the horizontal. The main frame of the apparatus comprises a pair of C-shaped side cheeks and a strongly constructed so-called block is employed for supporting the table plate, wherein the block connects the pair of C-shaped side cheeks. The plate disposed on the feed device in the processing plane is led in longitudinal direction, i.e. from the front side toward the press feed opening, toward the table of the punching device and is then processed in transverse steps and longitudinal steps. The disadvantages of this press frame construction include obviously that, based on the spreading apart of the C-shaped frame upon cutting of sheet-metal plates, there exist narrow limits with respect to the tool life and the number of the tools which can be employed in the course of cutting of sheet-metal plates. In addition, a higher frequency of cutting sequences is hardly possible, since the smallest wear of contemporary tools already generates a damaging of the tools overall based on the stretching apart of the C-shaped frame. In addition, a generated cut edge burr at the tool pieces is a consequence of a wear of the tools and can lead to a prematurely required change of tools.

In addition, a laying and horizontally disposed C-frame press is known from the German Patent DE-PS 508,474, wherein the starting material plates pass to processing between two feed roll pairs disposed in a vertical position. The starting material plate is initially led and guided step-by-step and in sequence in the processing plant past a tool, disposed perpendicular to the laying and horizontally disposed press, wherein blanks are produced. Then, the scrap grate, generated during the cutting out of the blanks, is separately cut out by a scrap cutter from the residual starting material plate and is removed from the laying and horizontally disposed press.

The starting material plate, furnished with a new leading edge according to the process described above, passes thereupon between continuous belts, which continuous belts transport the just generated reduced material plate around the rear of the laying and horizontally disposed C-frame press to that side of the press, on which the feed roller pairs are disposed. Thereupon, a further row of workpieces or, respectively, scrap parts is separated from the plate. The disadvantages of this laying and horizontally disposed C-frame press comprise in addition that an expanding of the C-frame results in the already described disadvantages which have been pointed to in connection with the German Patent DE-PS 177,684. A further substantial disadvantage is recognized in the required large floor space requirement of the press with the feed advance device, wherein the continuous belts are in each case disposed laterally of the laying and horizontally disposed press table and have to be guided around the rear of the laying and horizontally disposed press head.

In order to increase the work-cycle frequencies at the conventional, inclinedly constructed C-frame press, one has moved in the past from the sheet-metal plate processing to the sheet-metal strip processing. In connection with the sheet-metal strip processing, the usual expanding of the C-frame press is substantially prevented by way of stud bolts, disposed left and right between the table and the side cheeks at the so-called press feed opening, wherein however the higher expenditure of the production sheet-metal strips requiring a sheet-metal strip cutter is knowingly accepted. This higher expenditure comprises further that a sheet-metal strip magazine has to be refilled relatively quickly based on the high operating frequencies.

Furthermore, plate processing devices at C-frame presses are also known, which perform the plate processing in a horizontal processing plane, as taught for example in the PCT document WO 94/08740. In this case, a horizontal table is furnished in front of the C-frame press, wherein the surface of the horizontal table is disposed in one plane together with the surface of the lower tool stand. At least a first cutting process for separating a work piece from the sheet-metal plate is performed on a sheet-metal plate, wherein the sheet-metal plate is fed from the side to the C-frame press and is moved through this C-frame press. The through-cutting and separation of the just generated cutting edges is performed in a second cutting process. Based on the C-frame press, the already described disadvantages occur, such as an expanding of the C-frame and the therewith associated premature wear problems, at the tools. On the other hand, the plate processing in a horizontal plane results in a larger floor space requirement.

The C-frame presses, in connection with which the invention apparatus for the sheet-metal process is to be employed, are known. In general, inclined presses of the type C-frame press are outfitted with so-called "pull anchors," whereby a frame elastic support, occurring during the stamping or press process, is prevented. It is however a disadvantage that these pull anchors, which are disposed immediately on the left-hand side and on the right-hand side at the operating region of the press, where the pull anchors connect the press main region with the press table region, allow only a feeding in and a processing of sheet-metal strips. These pull anchors prevent in general a processing of a plate. However, if the pull anchors are demounted, there results a press which offers the required space for a sheet-metal plate processing, where however the required rigidity of the press is no longer present. This rigidity is however an absolutely necessary prerequisite for the use of carbide-tipped tools in order that high stroke numbers and the least cutting burrs can be expected.

If such a C-frame press, which does no longer include pull anchors, is equipped with the invention apparatus, then entire plates can be processed since the required rigidity of the press can be assured with the apparatus according to the present invention.

SUMMARY OF THE INVENTION

PURPOSES OF THE INVENTION

It is an object of the present invention to furnish a compact apparatus for plate processing at high and precise operating frequencies and to integrate this apparatus into a C-frame press, positioned at an inclination angle, wherein the apparatus is characterized by a small floor space requirement.

It is a further object of the present invention to provide a C-frame press, where free and easy accessibility is assured, wherein the expanding of the C-frame is kept to a minimum, and wherein high accuracies, accuracies as to size, and dimensional accuracies are achieved at relatively high operating frequencies.

These and other objects and advantages of the present invention will become evident from the description which follows.

BRIEF DESCRIPTION OF THE INVENTION

The present invention provides for an apparatus for a plate processing at inclined C-frame presses for an automatic cutting of tin-can covers and lids of tin cans and the like from sheet-metal plates. A first c-shaped bracing is attached to a first side of a C-shaped press frame. A second c-shaped bracing is attached to a second side of the C-shaped press frame. A u-shape-formed frame including a first longitudinal traverse is attached to the first c-shaped bracing and a second longitudinal traverse is attached to the second c-shaped bracing. A piston plunger to the C-shaped press frame and capable of moving up and down provided for moving up and down. There are further provided means for leading a sheet-metal plate step-by-step past under the piston plunger of the press frame.

The u-shape-formed frame can include a cross traverse. A motor drive train unit can be disposed at the cross traverse. A drive shaft can be attached to the motor drive train unit. The drive shaft can be disposed above the cross traverse.

The device for moving a transport traverse, for example, a drive train, can be disposed in one of the first longitudinal traverse and of the second longitudinal traverse.

The transport traverse can be disposed perpendicular to the longitudinal traverse. A linear module can be formed in the transport traverse. At least two gripper means can be disposed at the linear module.

The C-shaped press frame can be disposed at a first angle of from about 3 degree to 15 degrees relative to an operating plane of punching out, and preferably at a first angle of from about 3 degree to 5 degrees.

A plate feed of the apparatus can be disposed laterally relative to the C-shaped press frame and disposed in an operating plane.

The first c-shaped bracing can exhibit an open end and can be angled toward to the press table at the open end. The open end of the first c-shaped bracing can surround a tie bolt disposed at the c-shaped press frame. The first c-shaped bracing can be disposed at a distance relative to the c-shaped press frame.

According to the present invention, the apparatus comprises a u-shaped frame, wherein the longitudinal traverses of the u-shaped frame are in each case connected through a c-shaped bracing with the C-shaped press frame. A drive shaft with a motor drive train unit is disposed at a cross traverse of the u-shaped frame. The drive shaft can be disposed within the cross traverse. A device for moving the transporting traverse is disposed in the longitudinal traverses. The transport traverse, disposed perpendicular to the longitudinal traverse, comprises a linear module, and at least two gripper is disposed at the linear module. The gripper is formed as tongues and grip the sheet-metal plate at the upper end of the sheet-metal plate, wherein the sheet-metal plate is taken from a plate magazine and is aligned in the positioning station for being received by the plate feed. The plate is guided at its lower end by a limit stop, where the limit stop extends up to the metal-forming tool. The sheet-metal plate is now transported by way of the transport traverse to the metal-forming tool, and is moved in individual steps along the x axis through the metal-forming tool. The metal-forming tool sequentially punches out blanks from the sheet-metal plate. At the same time, the punching grate is cut off section by section by way of a cutter device, disposed at the metal-forming tool, and the punching grate is led away from the tool region. After the last stamping process in the respective row, the transport traverse is then moved in Y direction toward the metal-forming tool and again the transport traverse is moved by the metal-forming tool. The punch-outs of the successive rows are performed in each case staggered relative to the preceding row until the entire sheet-metal plate has been completely processed. In the following, the opened tongues at the transport traverse are moved in the direction of the positioning station, wherein the transport traverse is simultaneously moved in Y-direction and in fact away from the metal-forming tool, and wherein the opened tongues grip the next aligned sheet-metal plate.

It is an object of the invention to keep the spreading apart of the construction of the press at least within the normal limits and thus to assure a processing of plates, wherein savings in space are also achieved based on the inclined construction of the conventional press, as known in the art but now equipped with the invention apparatus. The invention apparatus for the processing of plates now projects as it were into the air space above the press based on the inclined positioning.

The apparatus is disposed at an inclined C-frame press at an angle in a range from about 0 degree to 15 degrees relative to the operating plane, and preferably in a range of 3 degrees to 5 degrees relative to the operating plate.

The C-frame press, employed in an inclined position for plate processing, exhibits a c-shaped bracing at the frame formed in c-shape when considering a cross-section. The c-shaped bracings are constructed such that they are angled off at their open ends toward the press table, and the c-shaped bracings surround in each case the tie bolts disposed at the press frame. The c-shaped bracing or the c-shaped bracings are disposed at a distance relative to the c-shaped frame. The c-shaped bracings minimize the expanding of the C-frame during the punching process. In order to assure the accessibility for the processing of plates, the bracings are constructed such that they follow the shape of the C-frame. In conventional C-frame presses, tie rods are disposed at the open end of the press frame in order to minimize the expanding at the C-frame. Only sheet-metal strips can be processed based on this construction, wherein the width is dependent on the size of the opening of the C-frame.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
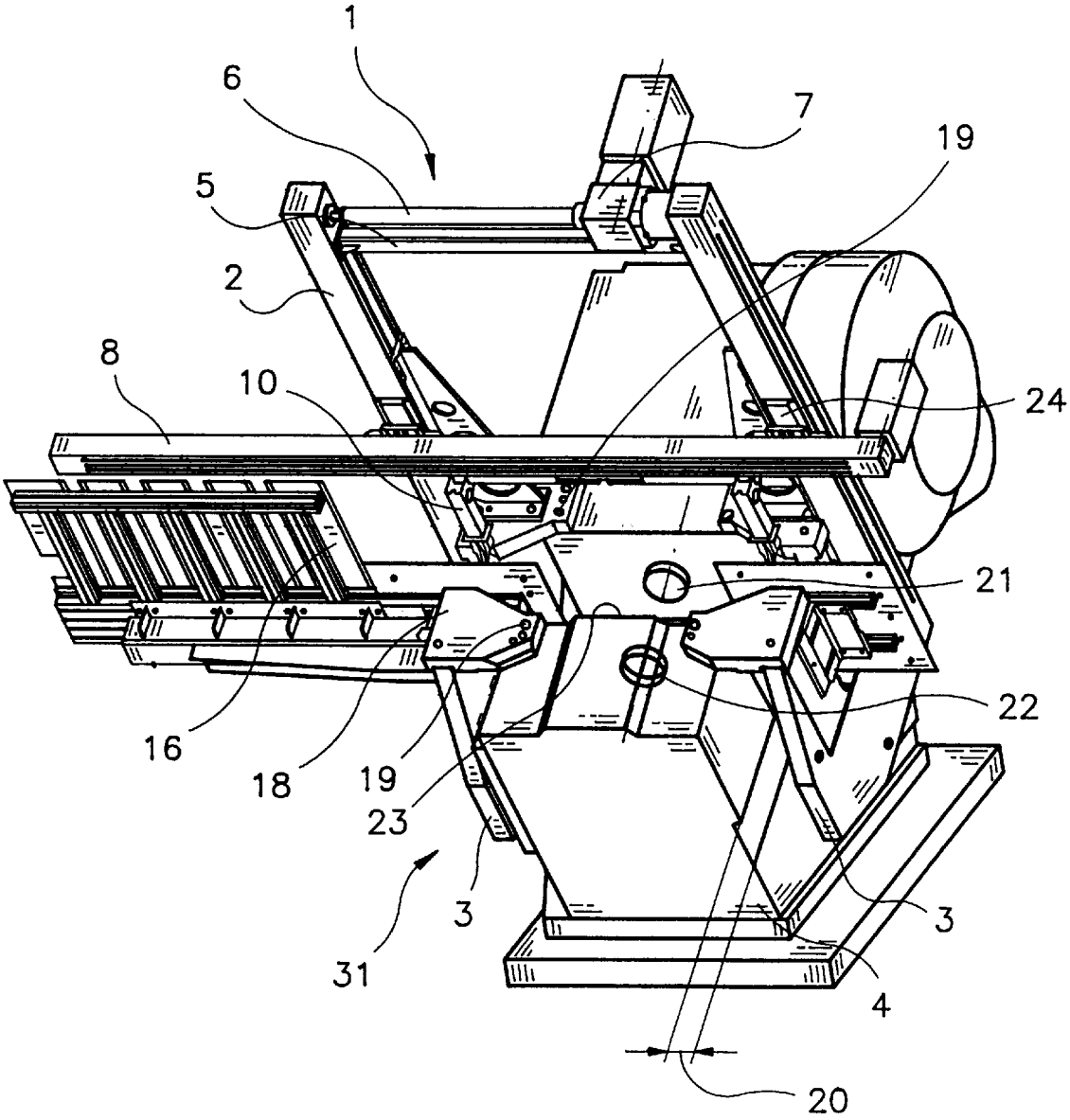
FIG. 1 is a perspective overall view of the invention apparatus with an inclined C-frame press in a front, top right view.

The present invention provides for an apparatus for a plate processing at inclined C-frame presses for an automatic cutting of tin-can covers and lids of tin cans and the like from sheet-metal plates with a piston plunger 21 of a press moving up and down. The sheet-metal plate is led step-by-step past under the piston plunger 21 of the press. The apparatus includes a u-shape-formed frame 1. The longitudinal traverses 2 are in each case connected through a c-shaped bracing 3 to a C-shaped press frame 4.

The C-shaped press frame shows the horizontal axis of the C inclined by an angle 11 relative to a horizontal plane. The width of the arms and of the floor of the C-shaped press preferably do not vary more than by about 20 percent over the extent of the C. The depth of the open inner area of the C is about one to two times the width of the arms of the C-shaped press.

A drive shaft 6 with a motor drive train unit 7 can be disposed at the cross traverse 5 of the u-shape-formed frame 1. The drive shaft 6 can be disposed above the cross traverse 5. A device for moving a transport traverse 8, for example a drive train, can be disposed in the longitudinal traverses 2. The device for moving a transport traverse 8 can be a guide train 24. The transport traverse 8, disposed perpendicular to the longitudinal traverse 2, can comprise a linear module 9. At least two gripper means 10 can be disposed at the linear module 9. The apparatus can be disposed at an inclined C-frame press 31 under an angle 12 in a range of from 0 degree to 15 degrees relative to an operating plane 13. A plate feed 16 of the apparatus can be disposed laterally relative to the C-shaped press frame in an operating plane 13 corresponding to the plane of sheet metal-plates when the tin covers and the lids of the tin cans are punched out form the sheet metal-plates.

The apparatus can be disposed at an inclined C-frame press 31 under an angle 12 in a range of from 3 degrees to 5 degrees relative to an operating plane 13. A c-shaped bracing 3 can be disposed at a c-shaped press frame 4 of an inclined press. The c-shaped press frame can exhibit a c-shaped cross-section. The c-shaped bracing 3 at its open ends 18 can be is angled toward to the press table 23. The open ends 18 of the c-shaped bracing 3 can surround in each case tie bolts 19, disposed at the press frame. The c-shaped bracing 3 can be disposed at two sides of the c-shaped press frame 4. The c-shaped bracing or c-shaped bracings can be disposed at a distance 20 relative to the c-shaped frame.

This distance 20 means that different types of presses can be equipped with the apparatus according to the present invention. Accordingly, as a rule, the invention apparatus is only to be constructed larger relative to this distance 20 in order to allow that types of presses of various manufacturers can be equipped with an apparatus for the processing of plates. A merging of the c-shaped bracing 3 and the c-shaped press frame 4, i.e. a value zero for the distance 20, is thereby excluded since prevailing presses of the type C-frame press 31 exhibit very obviously also different elevations etc. at the regions where the c-shaped bracings are to be disposed on both sides, where said elevations are to be or have to be bridged by the distance 20. The distance 20 is preferably of a magnitude of from about 0.5 to 2.0 times the thickness of the c-shaped bracing 3.

The invention device for the processing of sheet-metal plates is illustrated in FIG. 1 in a perspective overall view with a C-frame press 31, constructed for an inclined operating plane. The sheet-metal-processing apparatus comprises a u-shape-formed frame 1, which u-shape-formed frame 1 comprises two longitudinal traverses 2 and a cross traverse 5, connecting the longitudinal traverses 2. The longitudinal traverses 2 end on the side of the c-shaped press frame 4 at the c-shaped bracings 3, disposed left and right at the press frame, and in fact on the side at the height level of the ram guides. The bracings 3 and the press-frame 4 are aligned sequentially in a direction perpendicular to the plane of the respective "c".

On the other hand, the u-shape-formed frame 1 protrudes far into the space above the press. A motor drive train unit 7 with a drive shaft 6, connecting the two longitudinal traverses 2, is furnished here above the cross traverse 5.

A transport traverse 8 with a linear module 9 and far projecting to at least one side of the u-shape-formed frame 1 is disposed perpendicular at the two longitudinal traverses 2. This linear module 9 carries two grippers 10, disposed at a horizontal distance, which grippers 10 according to the present embodiment are represented by two gripper tongues. The sheet-metal-plate feed 16 is illustrated in FIG. 1 at the transport traverse 8 far projecting on the left. At this position, the respective sheet-metal plate is furnished and made available, the respective sheet-metal plate is aligned according to pressure markings, the respective sheet-metal plate is adjusted, and the respective sheet-metal plate is gripped at the upper longitudinal edge by the two gripper tongues 10, disposed at a distance from each other.

The c-shaped bracings 3, on the left and on the right of the c-shaped press frame 4, are disposed at a defined distance 20 relative to the press frame 4.

These c-shaped bracings 3 at the press frame are formed at an angle with their open ends 18 toward the press and surround and are held by the tie bolts 19, which tie bolts 19 lead the c-shaped bracings only to a tie or anchor bracing with the c-shaped press frame 4 of the inclined press or attach the c-shaped bracings 3 to the c-shaped press frame 4 of the inclined press.

According to FIG. 1, the c-shaped bracings 3 are formed of a c-shaped metal plate fabricated into an overall c-shape. The arms of the "c" can exhibit a narrowing toward the end of the arms. A connection metal plate is attached solidly to the end of each arm of the c-shaped metal plate and the connection metal plate is bolted to the press frame 4. The plane of the connection metal plate is disposed perpendicular to the plane of the c-shaped metal plate.

The inclined C-frame press 31 has also to be suitable for the discharge of the parts stamped out of the metal plate, for example tin-can covers. For this purpose, a breakout/opening is provided at the C-frame press 31 in the region behind the tools, i.e. plunger 21, matrix 22. In other words, a large opening is in the press between the two c-frame parts behind the tools, where the opening as a rule reduces the stiffness to a large degree relative to a construction, which does not exhibit such an opening at this location of the press.

The tie bolts 19 which are disposed on both sides, both at the press table 23 as well as at the upper part of the press, laterally of the plunger 21, one could speak of adapter placements, embody the respective locations where, up to now, in a press with so-called pull anchors, the attachment of these pull anchors were located. The placement of these tie bolts 19 is now again employed in order to use the c-shaped bracing on both sides of the c-shaped press frame. Only the pull anchors are demounted from the already present press and are replaced with the c-shaped bracings of the present invention. This construction provides for the free access/throughput in the press for the large and entire sheet-metal plates.

Based on the breakout opening present within the frame of the press, up to now the stiffness and rigidity has been provided by pull anchors. However, if these pull anchors are demounted because they prevent a processing of plates, then such construction of a press is not sufficiently rigid or stiff. A press without pull anchors would thereby expand by elasticity or, respectively, spread apart. Based on the invention arrangement of c-shaped bracings 3, which follow the form of the C-frame, the original stiffness and rigidity are restored.

The expression C-frame press means that the press is comprised of a projecting body, where the body exhibits the shape of the letter C when viewed from the side.

In contrast, the apparatus for the processing of plates is comprised of a u-shape-formed frame 1. According to FIG. 1, the u-shape-formed frame 1 is comprised of the cross traverse 5 and of the two longitudinal traverses 2, where the two longitudinal traverses 2 at the c-shaped press frame 4 end on the two sides at this c-shaped press frame 4 with the c-shaped bracings. One of the c-shaped bracings 3 can be clearly recognized in the side view of FIG. 2. The operating plane 3 is shown as a breakout, forming an opening, between the c-shaped bracings 3.

In case of a c-shape, the inner form of the "c" is formed with a more or less defined radius between the inner straight faces of the such formed body. Therefore, the c-shaped bracings 3 shows in FIG. 2 this recited radius. In contrast, a u-shape does not need to exhibit these recited radii, for example, the u-shape-formed frame 1 according to FIG. 1 does not exhibit such radii. The u-shape-formed frame 1 is comprised of the parts: cross traverse 5 and the two longitudinal traverses 2. This cross traverse 5 is in each case connected at right angles to the longitudinal traverses 2. In this case, no intended curve-shaped connection between the two recited parts, cross traverse 5 and longitudinal traverse 2 can be recognized.

The C-frame press exhibits defined radius connections between the operating table and the plunger in the rear region of the C-frame press, the press frame and the press-frame center part. These radii and roundings or curved forms should in general be regarded as c-shapes.

Figure 2:
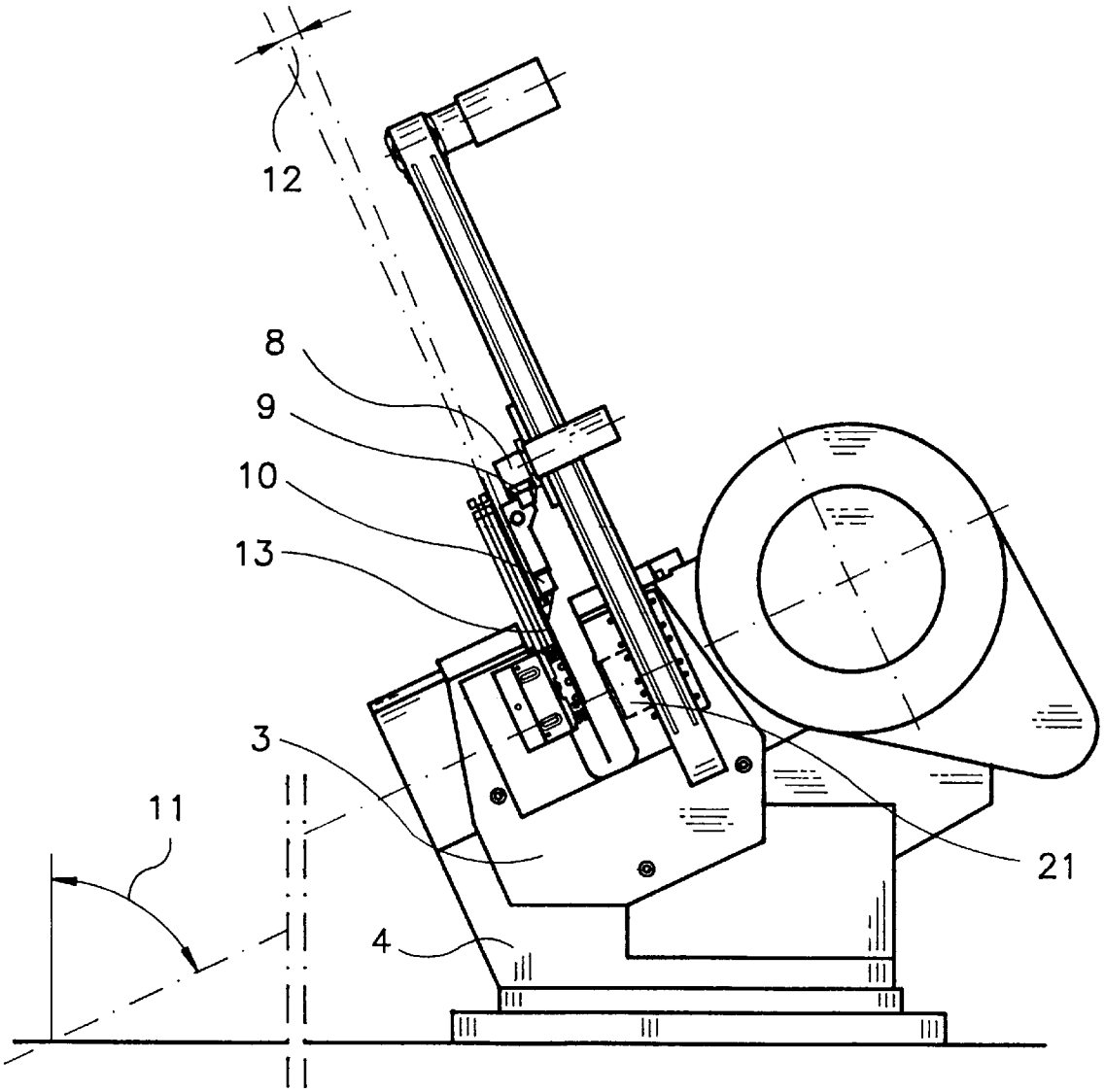
FIG. 2 is a side elevational view X of the apparatus according to FIG. 1.

According to FIG. 2, the c-shaped bracing 3 also exhibits inner radii.

A C-frame press is to keep the spreading apart of the construction, occurring during an operating stroke or a stamping, as small as possible. For high spreading forces or also high stroke numbers, such a C-frame press is less suitable based in fact on this elasticity as a result of the c-shape as compared to straight-side presses. These connections between the individual frame parts, i.e. between the frame upper part and the frame lower part, should be provided with radii, roundings, curvatures through the frame center part, generally referred to a c-shape, to support the continuous subjection to stress.

A side view X according to the representation of the arrow in FIG. 1 is shown in FIG. 2. In this case, the inclination angle 11 of the C-frame press 31 is clearly recognizable relative to a vertical direction. Furthermore, the processing apparatus, ending far above the press, is also recognizable. In addition, the permissible angle range 12 is shown, in which the invention device can be disposed for positioning the operating plane 13.

The mode of operation of the invention apparatus for processing sheet-metal plates on an inclined C-frame press 31 is described in the following.

According to the invention, the c-shaped bracing 3 of the c-shaped press frame 4 assures that the c-shaped press frame 4 exhibits the same resistance to frame stretch as compared to conventionally anchored C-frame presses 31 despite the open "press feed opening." The c-shaped bracings 3 form at the same time a receiving plane, neutral relative to the press, for the processing apparatus. The longitudinal traverses 2 are formed on the faces of the c-shaped bracings 3 and perform at the same time the function of the linear module in Y direction. The Y direction is aligned parallel to the traverses 2. The drive of the two linear modules along the longitudinal direction of the traverses 2 is performed through the motor drive train unit 7 by way of the drive shaft 6. Thus, the transport traverse 8 can be moved in a defined way in Y direction according to the algorithms residing in the program of the control system. The transport traverse includes the function of the linear module 9. The grippers 10 are disposed at the linear module 9 at a distance relative to the outer edges of the sheet-metal-plate format to be processed and the grippers 10 assure the motion in the X direction over the linear module 9 according to the algorithm furnished and residing in the control system.

The sheet-metal plate, not illustrated in the example, is moved by way of the grippers 10 in the processing plane 13.

A sheet-metal plate is furnished such in the plate feed 16 that the sheet-metal plate is punched out after the alignment according to the furnished pressure marking and after gripping by the grippers 10 only based on a moving in the X direction in the first row. The X direction is marked in FIG. 1 and extends parallel to the longitudinal extension of the transport traverse 8.

The plate is transported in X direction and is brought to a first punching out in the insertion window in order to be transported then in the press cycle further in the X direction and, in fact, in such a manner until the first row of the table is punched out. The Y axis moves the complete X axis including gripper. Then the step for the punching out of the second row is performed based on a motion in the Y direction or, respectively, by a motion in Y direction and X direction depending on the particular subdivision of the sheet-metal plate. Thus, the second row can be punched out in a negative X direction. This means that the advance direction can alternate for successive rows to be stamped out between a forward direction in x-axis direction and a backward direction in x-axis direction. Simultaneously, the punching grate of the first row is separated step by step with each ram stroke with a cutting unit, integrated in the cut-pull tool, wherein the punching grate of the first row is carried along at the sheet-metal plate over the remaining webs. The cutting unit is constructed such that after the complete punching out of the second row of tin-can covers or lids, the stamping grate of the first row is completely cut off and separated.

Thus, the processing advance of the sheet-metal plate in Y direction up to the punching out of the last row is assured, since the remaining stamping grate of the preceding row is in each case in principle separated together and simultaneously after the punching out of each row of tin-can covers or lids. The stamping grate of the last row remains in the grippers 10 after the performed last punch stroke for production of a tin-can cover or lid. These grippers 10 move with the residual grate simultaneously in X and Y direction from the operating plane 13 back into the plate feed 16 behind a newly made available sheet-metal plate. There, the residual grate is released, i.e. thrown off, and the new sheet-metal plate now made available is gripped and is brought again to a first punching-out step in the next possible insertion window.

The C-frame press 31 performs empty strokes during a time period from the last punching out of the first sheet-metal plate up to the beginning of the punching out of the next sheet-metal plate. The number of these empty strokes depends in principle on the subdivision of the sheet-metal plates.

This construction meets the initially presented object of the present invention, namely to furnish and integrate a compact apparatus for sheet-metal-plate processing for high and precise operating frequencies in connection with an inclined C-frame press, wherein the compact apparatus for sheet-metal-plate processing is characterized relative to the state of the art by a substantially lower floor space requirement.

Based on the u-shape-formed frame according to the invention in connection with the c-shaped bracing at the C-frame press, high and precise operating frequencies become possible even when processing sheet-metal plates.

The free accessibility to the C-frame press is assured and the expanding of the C-frame is kept to a minimum based on the construction of the present invention and the processing arrangement.

It will be understood that each of the elements described above, or two or more together, may also find a useful application in other types of presses differing from the types described above.

While the invention has been illustrated and described as embodied in the context of an apparatus for plate processing at C-frame presses and a correspondingly constructed C-frame press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

We claim:

1. An apparatus for a plate processing at inclined C-frame presses for an automatic cutting of tin-can covers and lids of tin cans comprising a C-shaped press frame;

a first c-shaped bracing attached to a first side of the C-shaped press frame;

a second c-shaped bracing attached to a second side of the C-shaped press frame;

a u-shape-formed frame including a first longitudinal traverse attached to the first c-shaped bracing and a second longitudinal traverse attached to the second c-shaped bracing;

a piston plunger attached to the C-shaped press frame and capable of moving up and down for cutting tin covers and lids of tin cans;

means for leading a sheet-metal plate step-by-step past under the piston plunger.

2. The apparatus according to claim 1, wherein the u-shape-formed frame includes a cross traverse and further comprising a motor drive train unit disposed at the cross traverse;

a drive shaft attached to the motor drive train unit.

3. The apparatus according to claim 2, wherein the drive shaft is disposed above the cross traverse.

4. The apparatus according to claim 1, further comprising a transport traverse movably disposed at one of the first longitudinal traverse and the second longitudinal traverse; and a drive train for moving the transport traverse and disposed at one of the first longitudinal traverse and the second longitudinal traverse.

5. The apparatus according to claim 4, wherein the transport traverse is disposed perpendicular to the longitudinal traverse and wherein the apparatus further comprises a linear module formed in the transport traverse;

at least two gripper means disposed at the linear module.

6. The apparatus according to claim 1, wherein the C-shaped press frame is disposed at a first angle of from about 3 degree to 15 degrees relative to an operating plane corresponding to a plane of sheet metal-plates when the tin covers and the lids of the tin cans are punched out form the sheet metal-plates.

7. The apparatus according to claim 1, wherein the C-shaped press frame is disposed at a first angle of from about 3 degree to 5 degrees relative to an operating plane corresponding to a plane of sheet metal-plates, and wherein the tin covers and the lids of the tin cans are punched out form the sheet metal-plates.

8. The apparatus according to claim 1, further comprising a plate feed of the apparatus disposed laterally relative to the C-shaped press frame and disposed in an operating plane corresponding to a plane of sheet metal-plates, and wherein the tin covers and the lids of the tin cans are punched out form the sheet metal-plates.

9. The apparatus according to claim 1, wherein the first c-shaped bracing exhibits an open end and is angled toward to a press table at the open end, and wherein the open end of the first c-shaped bracing surrounds a tie bolt disposed at the C-shaped press frame.

10. The apparatus according to claim 9, wherein the first c-shaped bracing is disposed at a distance relative to the C-shaped press frame.

11. An apparatus for a plate processing at inclined C-frame presses for an automatic cutting of tin-can covers and lids of tin cans from sheet-metal plates comprising a C-shaped press frame (4);

longitudinal traverses (2) attached to the C-shaped press frame (4) by a c-shaped bracing (3), one c-shaped bracing (3) for one longitudinal traverse (2);

a piston plunger (21) moving up and down and attached to the C-shaped press frame;

means for leading a sheet-metal plate step-by-step past under the piston plunger.

12. The apparatus according to claim 11 further comprising a drive shaft (6) with a motor drive train unit (7) disposed at a cross traverse (5) attached to the longitudinal traverses (2) and forming with the longitudinal traverses (2) a u-shape-formed frame (1), wherein the drive shaft (6) is disposed above the cross traverse (5);

a longitudinal transport traverse (8) movably disposed at the longitudinal traverses (2), wherein the longitudinal transport traverse (8), disposed perpendicular to the longitudinal traverse (2), comprises a linear module (9), and wherein at least two gripper means (10) are disposed at the linear module (9);

a drive train (24) attached to the longitudinal traverses (2) and able to move the longitudinal transport traverse (8) wherein the longitudinal transport traverse (8) is disposed inclined under an angle (12) in a range of from 0 degree to 15 degrees relative to an operating plane (13) corresponding to a plane of sheet metal-plates, wherein the tin covers and the lids of the tin cans are punched out form the sheet metal-plates;

wherein a plate feed (16) of the apparatus is disposed laterally relative to the C-shaped press frame in the operating plane (13) corresponding to the plane of sheet metal-plates when the tin covers and the lids of the tin cans are punched out form the sheet metal-plates.

13. The apparatus according to claim 11, wherein the c-shaped press frame exhibits a c-shaped cross-section;

wherein the c-shaped bracing (3) at its open ends (18) is angled toward a press table (23), and wherein the open ends (18) of the c-shaped bracing (3) surround in each case tie bolts (19), disposed at the C-shaped press frame; wherein one c-shaped bracing (3) is disposed at each of two sides of the C-shaped press frame (4);

wherein the c-shaped bracing is disposed at a distance (20) relative to the C-shaped press frame.

* * * * *